United States Patent [19]

Ferguson

[11] 4,006,770

[45] Feb. 8, 1977

[54] WINDOW SHADE ASSEMBLY

[76] Inventor: Thomas A. Ferguson, 411 W. Galena, Freeport, Ill. 61032

[22] Filed: June 16, 1975

[21] Appl. No.: 586,873

[52] U.S. Cl. ..... 160/263; 160/323 R; 160/405

[51] Int. Cl.[2] ..... A47G 5/02

[58] Field of Search ..... 160/263, 264, 250, 21, 160/240, 238, 23 C, 23 R, 383–390, 323 R, 400, 405

[56] References Cited

UNITED STATES PATENTS

| | | | |
|---|---|---|---|
| 1,606,083 | 11/1926 | Klein | 160/384 |
| 1,898,686 | 2/1933 | Rice | 160/263 |
| 2,943,676 | 7/1960 | Grenci | 160/387 X |
| 3,099,916 | 8/1963 | Rosenbaum | 160/263 UX |
| 3,203,468 | 8/1965 | Gossling et al. | 160/263 X |
| 3,580,323 | 5/1971 | Gossling et al. | 160/263 |
| 3,913,655 | 10/1975 | Ogino | 160/383 X |

*Primary Examiner*—Philip C. Kannan

[57] ABSTRACT

A retractable window shade is disclosed employing slidably adjustable roller assembly and bottom slat, and a sheet of material having tear lines parallel to one edge and extending for the full length thereof.

12 Claims, 11 Drawing Figures

WINDOW SHADE ASSEMBLY

BACKGROUND OF THE INVENTION

1. Field of the Invention

The invention relates to retractable window shades and more particularly relates to retractable window shades of adjustable width.

2. Prior Art

Retractable window shades have been well known for many years. To provide a proper fit for the shades for windows of various widths, it is necessary to adjust the width of the entire shade assembly. A retractable shade assembly customarily consists of a sheet of vinyl or other material, a roller to which the sheet of material is attached, a spring driven motor for driving the roller and a light weight slat inserted in a seam along the bottom edge of the shade material to provide rigidity. The sheet may be made of a flexible material, such as a vinyl material which has been provided with tear lines parallel to one edge of the material, along which the material has been weakened, and may readily be torn to facilitate fitting of the shade to a window. Prior art shades have used rollers and bottom slats which must be cut by a saw or a like instrument. Furthermore, even when a shade is provided with tear lines, the lower edge of the material which is folded over and seamed, to house the bottom slat, must be cut at the seam by a knife or similar device.

SUMMARY OF THE INVENTION

It is an object of this invention to provide an extensible and retractable roll window shade assembly which may be readily adjustable in width without the use of any tools. It is a further object of the invention to provide a window shade which may be adjusted to width and prepared for hanging on support brackets in a few simple steps.

In accordance with this invention, a shade comprises a sheet of material provided with a plurality of tear lines along which the material may be readily torn. Furthermore, the shade is provided with a roller assembly comprising two telescoping sections to which the shade material is attached, and which houses a spring driven shade motor. The shade material is folded over along the bottom edge of the shade, in a known manner, and is seamed by means of an intermittent seam, in such a manner that no portion of the seam overlaps a tear line. A multiple section, light weight, adjustable length slat is provided for insertion in the pocket formed by the folded over section.

The telescoping roller sections of the roller assembly are interlocked to avoid rotation of one section relative to the other. A motor adaptor is provided at one end of the roller assembly for supporting a motor which attaches to a window shade support bracket. Further, an end pin adaptor is provided into which is inserted an end pin which may be supported by a second window shade support bracket. In the production assembly of the window shade, the roller, with the adaptors installed is extended to the full length of the shade material, as is the extendable bottom slat. An adhesive material is applied to the outside surface, in the longitudinal direction, of both the inner and outer section of the telescoping roller. The adhesive surface on the outside surface of the inner section, however, is covered with paper or another suitable protective material. When the shade is initially attached to the roller it is attached only along the adhesive surface on the outer section of the telescoping roller.

In accordance with this invention, installation of a new shade has been reduced to a few simple steps, which may be carried out without the need of tools. A window shade to be made in accordance with this invention, is first marked to the desired width by holding the shade in front of the window to be fitted. The inner section of the telescoping roller may then be pushed in until the length of the telescoping roller coincides with the desired width of the shade. The shade may then be unrolled and a strip of the window material corresponding to the excess width may be torn along the tear line most nearly corresponding to the outer edge of the newly positioned inner section of the telescoping roller. The excess material is torn along the full length of the tear line and after the bottom slat is adjusted to the desired width, the entire excess strip of material may be removed. The protective cover is then removed from the adhesive material on that portion of the inner section of the telescoping roller which extends beyond the outer section. The portion of the material overlapping the newly exposed adhesive is simply pressed down and the shade may be rolled up. When the extendable bottom slat has been adjusted to the desired length, the shade is ready for hanging.

BRIEF DESCRIPTION OF THE DRAWING

The invention is illustrated more or less diagrammatically in the accompanying drawing wherein.

DETAILED DESCRIPTION

Figure 1:
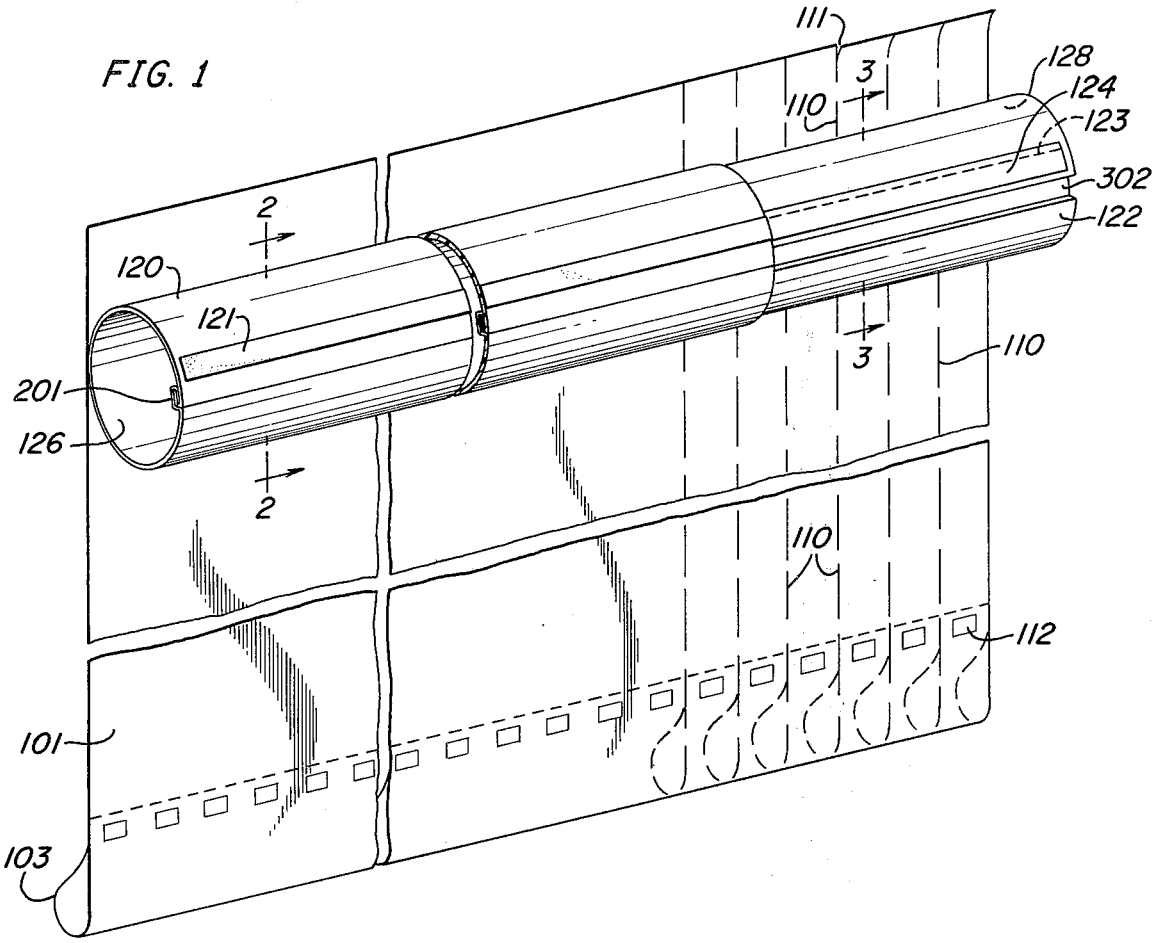
FIG. 1 is a perspective view of a window shade incorporating certain features of this invention.

In FIG. 1 is shown a sheet of material 101 having a plurality of tear lines 110 parallel to one edge of the material. Such tear lines may be formed by weakening the material along these lines. This may be done, for example, by perforation, making slits in the material without cutting through the material, or chemically weakening the material using an etching solution.

As those skilled in the art will appreciate, in each of the last two examples, no discontinuity will be present in one face of the sheet if the weakening means is applied only to a single face of the sheet. The end portion 111 of each of the tear lines may be cut through or scored to facilitate the tearing of the material along the tear lines. In this illustrative embodiment of the invention, the shade 101 may be attached to the outer section 120 of the telescoping roller by means of an adhesive area 121. An adhesive area 123 is also provided on the outer surface of the inner section 122 of the telescoping roller. However, the area 123 is covered with a paper overlay 124 or similar protective material which forms a temporary protective member and remains covered until the shade has been adjusted to the desired width, as will be explained later herein. Such adhesive material for the strips 121 and 123, which will adhere to the shade material, is readily commercially available. Further, as shown in FIG. 1, the lower portion of the shade material is folded over to form a pocket 103. A seam is made along the upper edge of the pocket. Such a seam may be made, for example, by known heat or ultrasonic sealing techniques. In accordance with this invention, in order to facilitate removal of a strip of material torn along one of the tear lines 110, the seam is formed in accordance with a specified pattern producing an interrupted seam comprising several individual sections 112 separated by sufficient distance to avoid overlap of any of the tear lines.

Figure 5:
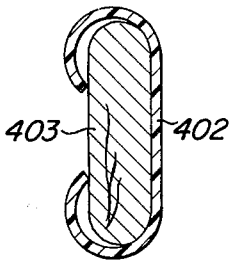
FIG. 5 is a cross-section of the bottom slat taken along line 5—5.
Figure 4:
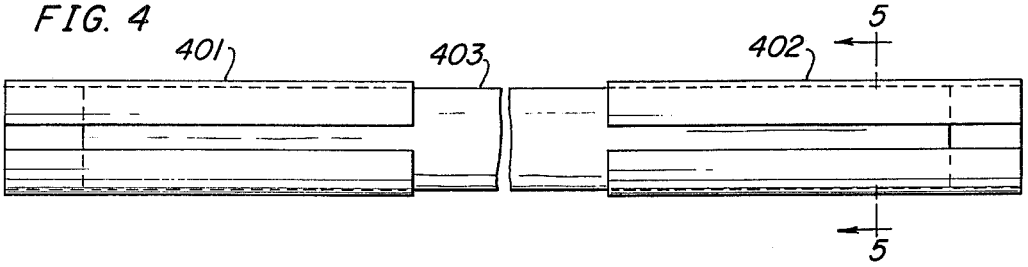
FIG. 4 is a front view of the adjustable bottom slat.

FIG. 4 shows a extendable bottom slat for use with the window shades such as may be inserted in the pocket 103. The extendable slat consists of three sections: two outer sections 401 and 402 which are substantially identical and may be made of a light weight material such as a rigid plastic or metal; and a center section 403, which may be made, for example, of light weight lumber or similar material. The dimensions of the center section 403 are chosen such that this section will fit snugly within sections 401 and 402 generally as shown in FIG. 5. FIG. 5 is a cross-section taken along the line 5—5 of FIG. 4 which shows the general construction of the external sections 401 and 402 and the center portion 403.

As mentioned earlier herein, the roller of the shade assembly consists of two telescoping sections.

Figure 2:
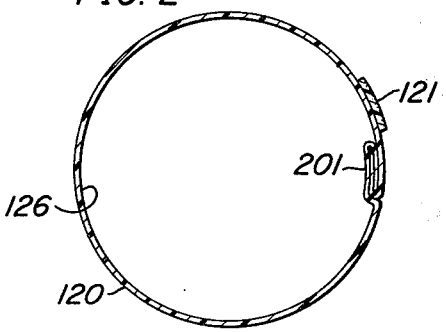
FIG. 2 is a cross-section of the outer section of the telescoping roller taken along the line 2—2.

A cross-section of the outer telescoping section 120 is shown in FIG. 2, as taken along the line 2—2 in FIG. 1. Section 120 comprises a hollow tube comprising a fold over seam 201 extending inwardly of the tube in such a manner that the external surface of the tube is substantially smooth and the inner surface of the tube is provided with a protrusion having a substantially rectangular shaped cross-section of a specified width and thickness.

Figure 3:
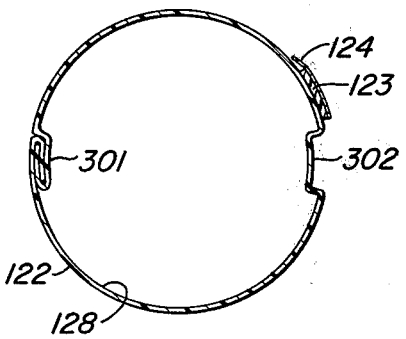
FIG. 3 is a cross-section of the inner section of the telescoping roller taken along the line 3—3.

FIG. 3 shows a cross-section of the section 122 which forms the inner tube of the telescoping roller. The tube 122 is provided with a seam 301 similar to the seam 201 of the tubular section 120. Additionally, the tubular section 122 is provided with a recess 302 having a substantially rectangular cross-section and having dimensions slightly greater than the rectangular cross-section of the seam 201 of the section 120.

Tubular section 122, like section 120, has a constant nominal diameter from end portion to end portion, the recess 302 forming the only discontinuity in the otherwise circular periphery of the section. When the two telescoping sections 120 and 122 are brought together, the seam 201 will be aligned with the recess 302 and when the section 122 is slideably engaged with the section 120, the seam 201 and the recess 302 cooperate to provide an interlock between the two sections to preclude rotation of one section relative to the other.

Figure 7:
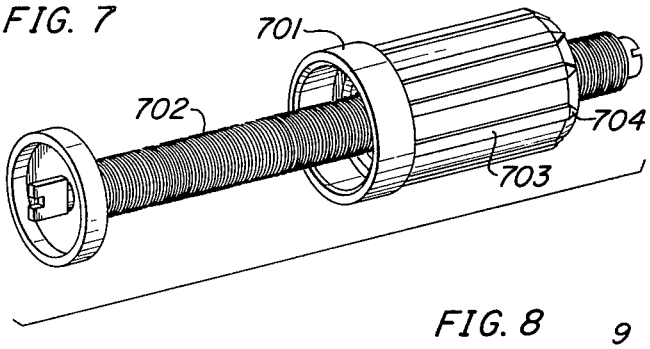
FIG. 7 is a perspective view of the shade motor and motor adaptor.
Figure 8:
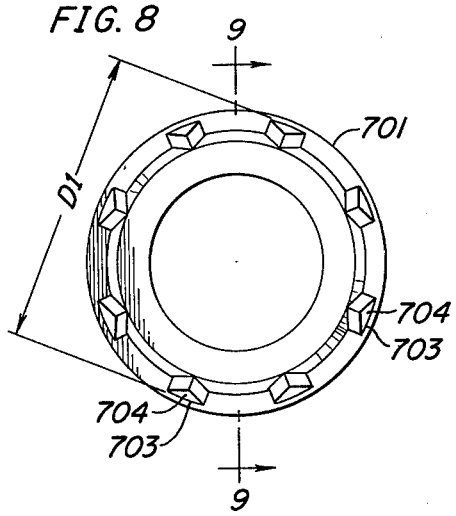
FIG. 8 is a front view of the shade motor adaptor.
Figure 9:
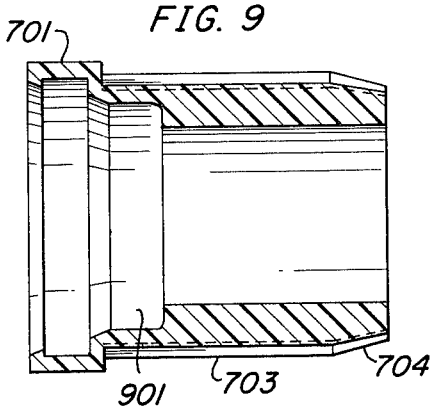
FIG. 9 is a cross-section of the motor adaptor taken along the line 9—9 of FIG. 8.

FIG. 7 shows a shade motor adaptor 701 and a well known spring driven shade motor, which provides the necessary power to retract the shade. FIG. 8 represents a front view of the motor adaptor and FIG. 9 shows a cross-section of the motor adaptor taken along the line 9—9 of FIG. 8. The adaptor which may be made of a plastic or the like material is inserted in the accessible end opening 126 of the outer section 120 of the telescoping roller. The adaptor is provided with several rib-like protrusions 703 having a slanted forward section 704. The diameter D1 indicated in FIG. 8 is selected to be slightly greater than the inside diameter of the tubular section 120 to allow for a snug fit of the adaptor inside the tube. The slanted forward sections 704 are provided to facilitate entry into the accessible end opening 126. The distance between adjacent ribbed sections 703 is selected to be sufficiently great to accommodate the seam 201. When inserted properly, the adaptor 701 will form an interlock with the seam 201 to prevent the rotation of the adaptor relative to the tubular section 120. A known retractor motor of the type depicted generally in FIG. 7, may be fitted in the recess 901.

Figure 6:
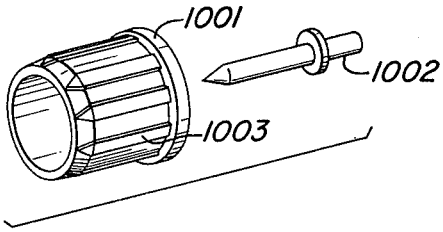
FIG. 6 is an exploded perspective view of the end pin and adaptor.
Figure 10:
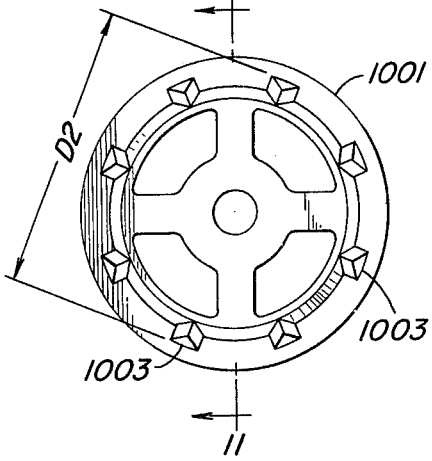
FIG. 10 is a front view of the end pin adaptor.
Figure 11:
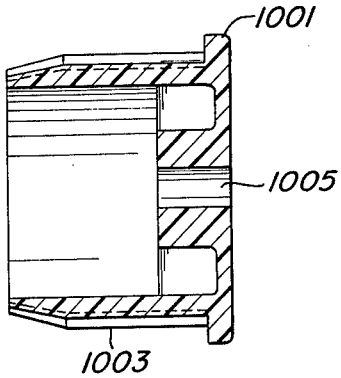
FIG. 11 is a sectional view of the end pin adaptor taken along the lines 11—11 of FIG. 10.

FIG. 6 shows an end pin adaptor 1001 and an end pin 1002. End pins similar to the one shown in FIG. 6 are well known. The adaptor has a general external shape similar to that of the motor adaptor 701. A front view of the end pin adaptor is shown in FIG. 10 and a cross-section taken along the line 11—11 of FIG. 10 is shown in FIG. 11. The end pin adaptor may be inserted in the accessible end 128 of the inner section 122 of the telescoping roller. The outside diameter D2 indicated in FIG. 10 is slightly more than the inside diameter of the section 122 to allow for a snug fit in the tubular end section. The distance between the ribbed sections 1003 is chosen such that the seam 301 and the recess 302 of the tubular section 122 will fit between adjacent ribbed sections, thereby providing a rotational interlock between the adaptor 1001 and the tubular section 122. The end pin 1002 may be inserted in the center opening 1005.

In the completed shade assembly, the motor adaptor 701 together with the motor 702 and the end pin adaptor 1001 together with the end pin 1002 will be inserted in the openings 126 and 128, respectively, of the telescoping roller. The telescoping roller will be extended to a length corresponding to the total width of the shade material 101 and the upper section of the shade 101, will be attached to the adhesive area 121 of the outer tubular section 120.

Since protective paper 124 overlies adhesive 123 at this time, the edge portion of the shade which overlies the exposed portion of the inner section 122 is unattached at this time. The bottom slat, (FIG. 4) will be inserted in the slat pocket 103 and extended to the full width of the shade material 101. In installing the shade, the desired width of the shade may be determined by holding the shade up to the window opening, and thereafter the shade may be torn along one of the tear lines 110 to obtain the desired width of the shade. After the bottom slat (FIG. 4) is removed or moved to one side, the shade may be torn along its full length without the use of any tools. An additional step in preparing the shade for mounting is to push the inner telescoping section 122 into the outer telescoping section 120 until the total length of the telescoping roller assembly corresponds to the width of the window. Thereafter, the overlay 124 is removed from that portion of the adhesive area 123 which is not covered by the outer telescoping section 120. The upper portion of the shade material 101 which overlaps the newly exposed adhesive area 123, is then attached thereto. The bottom slat may be reinserted and adjusted to a length corresponding to the new width of the shade by sliding the end sections 401 and 402 toward each other.

What is claimed is:

1. In an extensible and retractable roll window shade assembly which is width adjustable and installable by the consumer without the use of tools or cutting elements, the combination of a telescoping roller assembly, said telescoping roller assembly including a first roller section, said first roller section having a constant external diameter from end portion to end portion, the outer end portion of said first roller section having first means for supporting the window shade assembly from a first support location, the inner end portion of said first roller section having an opening therein of a size to receive a second roller section, said second roller section having a constant nominal external diameter from end portion to end portion, the outer end portion of said second roller section having second means for supporting the window shade assembly from a second support location, said second roller section being telescopically, slidably received within the first roller section whereby the length of the roller assembly can be adjustable within the limits of the range of telescoping movement, means for precluding relative rotation between the first and second roller sections, a shade of flexible sheet material, a first portion of the upper end of the shade being secured to the first roller section, one side portion of the shade having a plurality of lines of weakness which extend from the upper end of the shade to the lower end of the shade whereby the width of the shade can be adjusted to a desired width by separating a portion of the side of the shade from the balance of the shade, said separated portion being bounded, on the outside, by the original shade edge and, on the inside, by a line of weakness along which said portion is separated from the balance of the shade, said first and second telescoping roller sections being adjustable to an overall length which is at least as wide as the length of the final shade width without severance of any portion of either section, securement means for securing the second portion of the upper end of the shade, which is generally aligned with the second roller section, in fixed relationship to the second, smaller external diameter roller section with a substantially constant securing force from point to point along the length of the portion of the second roller section which extends beyond the end of the first roller section, whereby the positions of the first and second roller sections are fixed with respect to one another and to the shade throughout the entire area of overlap of the shade and the roller assembly.

2. The extensible and retractable roll window shade assembly of claim 1 further characterized in that said lines of weakness comprise continuous cut lines in which the depth of cut is less than the thickness of the shades throughout at least substantially the entire distance from the lower end to the upper end of the shade.

3. The extensible and retractable roll window shade assembly of claim 1 further characterized firstly, in that said lines of weakness comprise cut lines in which the depth of cut from the lower end of the shade to a location adjacent to the end of the shade is less than the thickness of the shade, and secondly, in that the cut lines extend completely through the thickness of the shade at one end portion of the shade to thereby provide a plurality of individual tabs which may be manually grasped and pulled for the purpose of severance of a side portion of the shade.

4. The extensible and retractable roll window shade assembly of claim 3 further characterized in that the tabs are formed at the upper end of the shade.

5. The extensible and retractable roll window shade assembly of claim 1 further characterized in that said securement means comprises an adhesive substance carried by the second roller section at locations commencing at the outer end portion thereof and extending inwardly substantially the entire length of said second roller section when it is extended to its maximum length with respect to the first roller section, and a temporary protective member overlying the adhesive substance at all points, said temporary protective member being removeable by hand from contact with the adhesive substance throughout that portion of the length of the second roller section which extends beyond the inner end of the first roller section, whereby the adhesive substance may remain unactivated until just prior to securement of the second portion of the upper end of the shade to the roller assembly.

6. The extensible and retractable roll window shade assembly of claim 1 further characterized in that said shade is composed of a plastic material having memory properties whereby the cut lines are virtually undiscernable to the naked eye.

7. The extensible and retractable roll window shade assembly of claim 1 further characterized by and including a slat pocket at the lower end of the shade, said slat pocket being formed by doubling the lower end of the shade upon itself, said doubled back portion being secured to the balance of the shade at discrete securement locations, the securement locations associated with the side portion of the shade having the aforesaid lines of weakness therein being located between said lines of weakness whereby severance of a side portion of the shade along a line of weakness will not intersect a securement location.

8. The extensible and retractable roll window shade assembly of claim 7 further including slat means received within said slat pocket, said slat means including a first section formed from wood of a length no greater than the width of the shade which contains no lines of weakness, and at least one second section which is carried by the first section and telescopically adjustable with respect to the first section whereby the overall length of the slat means can be adjusted by hand to a desired length which conforms to the final width of the shade.

9. The extensible and retractable roll window shade assembly of claim 13 further characterized in that the second section of said slat means is secured to the first section of said slat means by a friction fit.

10. For use in a roller window shade assembly,
a telescoping roller assembly, said telescoping roller assembly including, in combination,
a first roller section,
said first roller section having a constant external diameter from end portion to end portion thereof,
a second roller section,
said second roller section having a constant nominal external diameter from end portion to end portion thereof,
the external diameter of the first roller section being greater than the external diameter of the second roller section,
said second roller section being telescopically yieldably, slidably received within the first roller section whereby the length of the roller assembly is adjustable throughout the range of movement provided by the two sections,
means for precluding relative rotation between the first and second roller sections in all relative positions of one to another,
first shade securement means carried by the first roller section for securing a first portion of the upper end portion of a shade to said first roller section,
second shade securement means carried by the second roller section for securing a second portion of the upper end portion of said shade to said second roller section,
said first shade securement means being actuable independently of said second shade securement means
whereby said shade may be secured to the first, but not the second, of said roller sections,
said second shade securement means, when actuated, securing the second portion of the upper end portion of the shade to said second section, with at least the same securement force as the first shade securement means secures the first roller section to said first portion of said shade,
whereby said shade, upon actuation of the first and second securement means,
locks the two roller sections one to the other, and secures the shade directly to the two roller sections of dissimilar external diameters.

11. The telescoping roller assembly of claim 10 further characterized in that
said securement means comprises an adhesive substance carried by the second roller section at location commencing at the outer end portion thereof and extending inwardly throughout substantially the entire length of said second roller section when it is extended to its maximum length with respect to the first roller section, and
a temporary protective member overlying the adhesive substance at all points,
said temporary protective member being removeable by hand from contact with the adhesive substance throughout that portion of the length of the second roller section which extends beyond the inner end of the first roller section,
whereby the adhesive substance may remain unactivated until just prior to securement of a shade thereto.

12. A method of installing a window shade comprising a sheet of vinyl plastic material having a first and second end portion, a support roller comprising inner and outer telescoping sections, an adjustable length bottom slat, said sheet of material having a plurality of longitudinally extending tear lines therein, and a bottom slat pocket extending in a direction perpendicular to the direction of said tear lines formed by folding over said first end of said sheet, said folded over pocket section having seaming means formed by a plurality of seamed sections leaving spaces therebetween, certain of said spaces coinciding with said tear lines, said second end of said sheet being attached to said outer telescoping section, the steps of:
marking the desired width of the shade,
tearing said sheet along one of said tear lines most nearly coinciding with the marked width of the shade,
adjusting the telescoping roller to the desired width of the shade,
conforming attachment of said upper end of said sheet to said inner telescoping section,
adjusting the bottom slat to the desired width of said pocket, and inserting said slat therein.

* * * * *

UNITED STATES PATENT AND TRADEMARK OFFICE

CERTIFICATE OF CORRECTION

PATENT NO. : 4,006,770

DATED : February 8, 1977

INVENTOR(S) : Thomas A. Ferguson

It is certified that error appears in the above-identified patent and that said Letters Patent are hereby corrected as shown below:

The title box of the first page of the patent is corrected to read as follows:

After "(75) Inventor: Thomas A. Ferguson, 411 W. Galena, Freeport, Ill. 61032

Insert - Assignee: Newell Companies, Inc. Freeport, Illinois. -

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademarks*